US010490344B2

(12) United States Patent
Wei et al.

(10) Patent No.: US 10,490,344 B2
(45) Date of Patent: Nov. 26, 2019

(54) HIGH VOLTAGE TRANSFORMER APPARATUS

(71) Applicant: Delta Electronics (Shanghai) CO., LTD, Shanghai (CN)

(72) Inventors: Dong Wei, Shanghai (CN); Yao Tao, Shanghai (CN); Hongyuan Jin, Shanghai (CN); Dezhi Jiao, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 0 days.

(21) Appl. No.: 16/251,647

(22) Filed: Jan. 18, 2019

(65) Prior Publication Data

US 2019/0252115 A1 Aug. 15, 2019

(30) Foreign Application Priority Data

Feb. 13, 2018 (CN) ..... 2018 1 0150590

(51) Int. Cl.

| | |
|---|---|
| ***H01F 27/28*** | (2006.01) |
| ***H01F 30/12*** | (2006.01) |
| ***H01F 27/24*** | (2006.01) |
| ***H01F 27/42*** | (2006.01) |
| *H01F 27/40* | (2006.01) |

(52) U.S. Cl.

CPC ..... *H01F 30/12* (2013.01); *H01F 27/24* (2013.01); *H01F 27/28* (2013.01); *H01F 27/425* (2013.01); *H01F 2027/408* (2013.01)

(58) Field of Classification Search

CPC ..... H01F 2027/408; H01F 27/06; H01F 27/12

See application file for complete search history.

(56) References Cited

U.S. PATENT DOCUMENTS

| | | | | |
|---|---|---|---|---|
| 5,602,897 | A * | 2/1997 | Kociecki | H05G 1/06 378/101 |
| 6,642,829 | B1 * | 11/2003 | Carmena | H01F 27/06 336/180 |
| 2004/0061588 | A1 * | 4/2004 | Carmena | H01F 27/324 336/212 |

(Continued)

FOREIGN PATENT DOCUMENTS

| | | | |
|---|---|---|---|
| CN | 1179376 | C | 12/2004 |
| CN | 101226821 | B | 1/2011 |
| CN | 103052248 | A | 4/2013 |

*Primary Examiner* — Harry R Behm

(74) *Attorney, Agent, or Firm* — Yunling Ren

(57) ABSTRACT

A high voltage transformer apparatus, including: a tank; a high voltage transformer, disposed upright on one side within the tank, including a first transformer unit configured to generate a positive voltage and a second transformer unit configured to generate a negative voltage; a positive high voltage terminal and a negative high voltage terminal respectively disposed on the other side within the tank opposite to the first transformer unit and the second transformer unit; a first circuit board disposed between the first transformer unit, the first side wall, and the positive high voltage terminal; and a second circuit board disposed between the second transformer unit, the second side wall, and the negative high voltage terminal; wherein the first and second circuit boards are respectively configured to rectify, filter and sample the positive and negative voltages.

14 Claims, 5 Drawing Sheets

(56) References Cited

U.S. PATENT DOCUMENTS

2008/0094161 A1* 4/2008 Sung ..... H01F 30/06
336/170
2009/0009918 A1* 1/2009 Beland ..... H02M 1/088
361/58

* cited by examiner

HIGH VOLTAGE TRANSFORMER APPARATUS

CROSS REFERENCE

This application is based upon and claims priority to Chinese Patent Application No. 201810150590.4, filed on Feb. 13, 2018, the entire contents thereof are incorporated herein by reference.

TECHNICAL FIELD

The present disclosure relates to the field of power electronics, and in particular to a high voltage transformer apparatus in a high voltage generator.

BACKGROUND

High voltage generators are widely used in industrial and medical industries, and the design of high voltage transformer apparatuses (or commonly known as high voltage tanks) in high voltage generators is critical to the performance of the high voltage generators. Due to the high voltage (tens kV to 200 kV) exists in the high voltage tank, the design of insulation of the components themselves in the tank and the insulation between those components are very difficult.

In the related art practice, the high voltage components in a high voltage tank are divided into two groups, of which one group generates a positive voltage and the other group generates a negative voltage. The one group that generates the positive voltage includes a transformer that generates a positive voltage, a rectifier circuit board, a filter circuit board, a sampling circuit board, etc. The other group that generates the negative voltage includes a transformer that generates a negative voltage, a rectifier circuit board, a filter circuit board, a sampling circuit board, etc. Generally, a solid insulator is disposed between the two groups to prevent them from electrically interfering with each other. Therefore, there is a need to improve the high voltage tank in the related art, to provide a light weighted, compact and easily manufactured high voltage tank.

SUMMARY

According to one aspect of the present disclosure, there is provided a high voltage transformer apparatus, including:

a tank, comprising a first side wall and a second side wall;

a high voltage transformer, disposed upright on one side within the tank, including a first transformer unit configured to generate a positive voltage and a second transformer unit configured to generate a negative voltage;

a positive high voltage terminal and a negative high voltage terminal, respectively disposed on the other side within the tank opposite to the first transformer unit and the second transformer unit;

a first circuit board disposed between the first transformer unit, the first side wall, and the positive high voltage terminal; and a second circuit board disposed between the second transformer unit, the second side wall, and the negative high voltage terminal;

wherein the first circuit board is configured to rectify, filter and sample the positive voltage generated by the first transformer unit, and the second circuit board is configured to rectify, filter and sample the negative voltage generated by the second transformer unit.

BRIEF DESCRIPTION OF THE DRAWINGS

The above and other objects, features and advantages of the present disclosure will become more apparent from exemplary embodiments described in detail with reference to the accompanying drawings.

DETAILED DESCRIPTION

Figure 1:
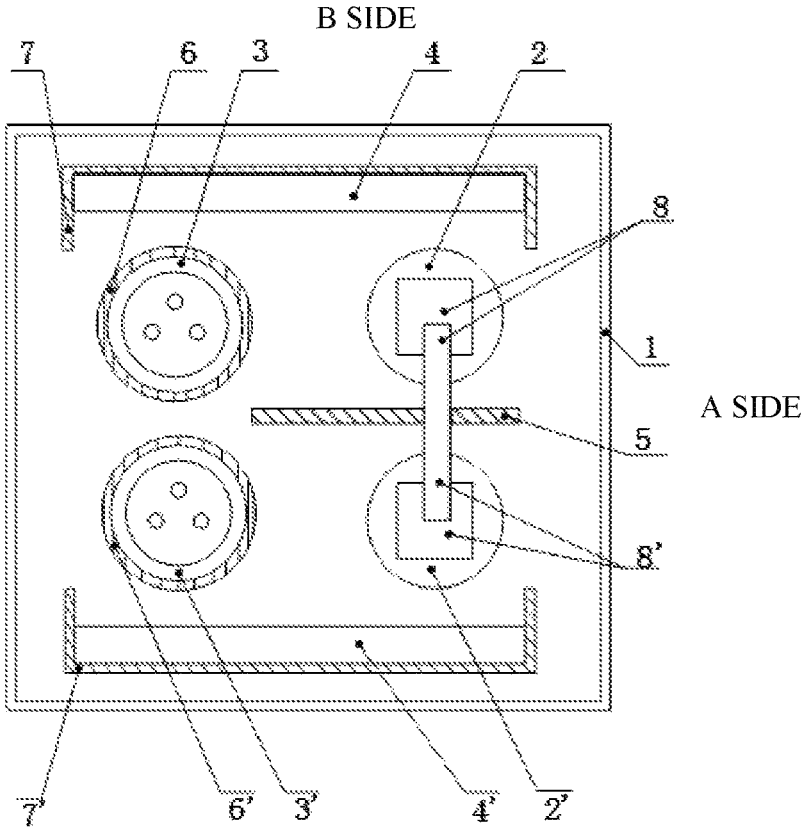
FIG. 1 is a top view of a high voltage transformer apparatus without a cover according to an exemplary embodiment of the present disclosure.

Example embodiments will now be described more fully with reference to the accompanying drawings. However, the exemplary embodiments can be embodied in a variety of forms and should not be construed as being limited to the examples set forth herein. Rather, these embodiments are provided to make the description of the present disclosure more comprehensive and complete, and to fully convey the concept of the exemplary embodiments to those skilled in the art. The drawings are only schematic representations of the present disclosure and are not necessarily drawn to scale. The same reference numerals in the drawings denote the same or similar parts, and the repeated description thereof will be omitted.

Furthermore, the described features, structures, or characteristics may be combined in any suitable manner in one or more embodiments. In the following description, specific details are set forth to enable thorough understanding of the embodiments of the present disclosure. However, those skilled in the art will appreciate that the technical solution of the present disclosure may be practiced without one or more of the specific details, or with other methods, devices, steps, etc. In other instances, well-known structures, methods, implementations, or operations are not shown or described in detail to avoid obscuring aspects of the present disclosure.

Some of the block diagrams shown in the figures are functional entities and do not necessarily have to correspond to physically or logically separated entities. These functional entities may be implemented in software, or implemented in one or more hardware modules or integrated circuits, or implemented in different network and/or processor devices and/or microcontroller devices.

To reduce the loss of the high voltage tank so as to improve the efficiency, and also to simplify the manufacture process of the high voltage tank, reduce the volume and weight, the related art practice faces the difficulties as follows.

Firstly, in the related art, each of the positive voltage group and the negative voltage group includes a set of numerous devices and circuit boards, so they may occupy large space and the connections between the boards and devices are complicated.

Secondly, the solid insulator between the positive voltage group and the negative voltage group is used to completely separate the two groups in the related art, which is unbeneficial for miniaturization of the high voltage tank.

Therefore, there is a demand to develop a new high voltage transformer apparatus in a high voltage generator with light weight, compact size and better efficiency.

The high voltage transformer apparatus of the present disclosure will be described in detail below with reference to the accompanying drawings and specific embodiments.

Figure 2:
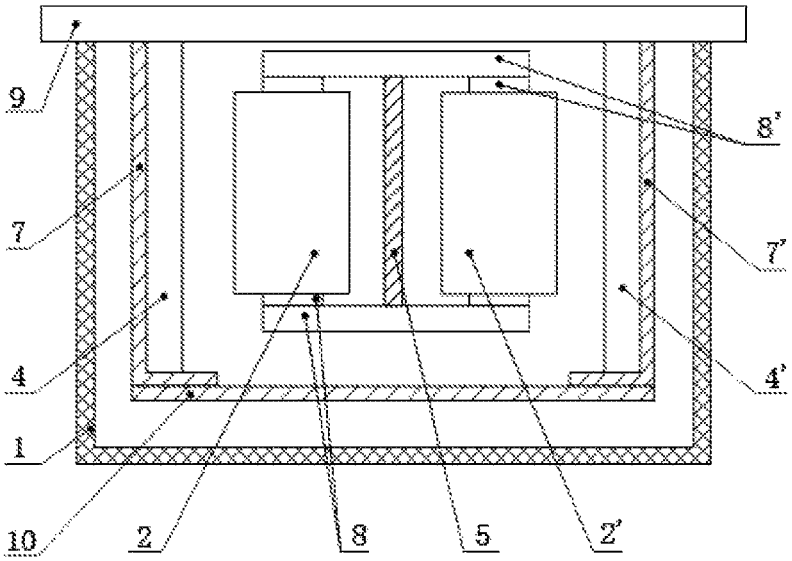
FIG. 2 is a side view of a high voltage transformer apparatus with the side wall of the tank on the A side removed, according to an exemplary embodiment of the present disclosure.
Figure 3:
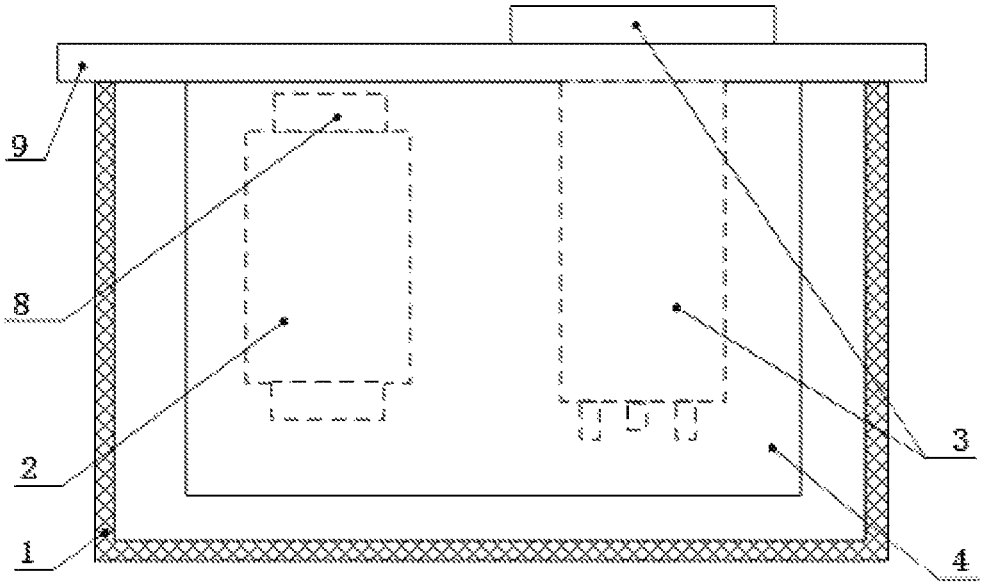
FIG. 3 is a side view of a high voltage transformer apparatus on the B side, according to an exemplary embodiment of the present disclosure.

The specific structure of the high voltage transformer of the present disclosure will be described in detail with reference to FIGS. 1-3. FIG. 1 is a top view of a high voltage transformer apparatus without a cover according to an exemplary embodiment of the present disclosure. FIG. 2 is a side view of a high voltage transformer apparatus with the wall of the tank on the A side removed, according to an exemplary embodiment of the present disclosure. FIG. 3 is a side view of a high voltage transformer apparatus on the B side, according to an exemplary embodiment of the present disclosure.

As shown in FIGS. 1-3, the high voltage transformer apparatus includes: a tank 1; a high voltage transformer, which is disposed upright on one side within the tank, and includes a first transformer unit 2 (including an iron core 8) configured to generate a positive voltage and a second transformer unit 2' (including an iron core 8') configured to generate a negative voltage; a positive high voltage terminal 3 and a negative high voltage terminal 3' respectively disposed on the other side within the tank opposite to the first transformer unit and the second transformer unit; a first circuit board 4 disposed between the first transformer unit and the first wall, and between the positive high voltage terminal and the first side wall; and a second circuit board 4' disposed between the second transformer unit and the second side wall, and between the negative high voltage terminal and the second side wall. The first circuit board is configured to rectify, filter and sample the positive voltage generated by the first transformer unit. The second circuit board is configured to rectify, filter and sample the negative voltage generated by the second transformer unit. By disposing the first and second transformer units that respectively generate positive and negative voltages on the same side of the tank in the high voltage transformer apparatus, the high voltage transformer apparatus can be more easily fabricated, more compact and lighter in weight.

According to an exemplary embodiment of the present disclosure, the first transformer unit 2 that generates a positive voltage and the second transformer unit 2' that generates a negative voltage are separated by an insulating plate 5 to provide a reliable insulation between the first transformer unit and the second transformer unit.

In addition to being separated by the insulating plate 5 between the first transformer unit and the second transformer unit, in order to achieve more reliable insulation, the present disclosure also provides various insulating methods, which are specifically described below.

According to an exemplary embodiment of the present disclosure, the positive high voltage terminal 3 and the negative high voltage terminal 3' are each coated with a first insulating layer 6, 6'.

According to an exemplary embodiment of the present disclosure, the high voltage transformer apparatus further includes a second insulating layer (7, 7' and 10) disposed between the first circuit board, the second circuit board and the respective adjacent areas of the side walls (indicated as 7, 7') and between the components in the tank and the bottom of the tank (indicated as 10).

According to an exemplary embodiment of the present disclosure, the tank may be further filled with insulating oil.

Thus, with a combination of one or more of the above various insulation methods according to the present disclosure, the distance between the high voltage components and the side walls can be reduced. The combination of solid insulating material and insulating oil makes it possible to reduce the distance between the high voltage components and the distance between the high voltage components and the side walls of the high voltage tank as much as possible while satisfying the requirements of high voltage insulation, so that the size of the tank can be reduced.

According to an exemplary embodiment of the present disclosure, the high voltage transformer apparatus further includes a tank cover 9.

Figure 5:
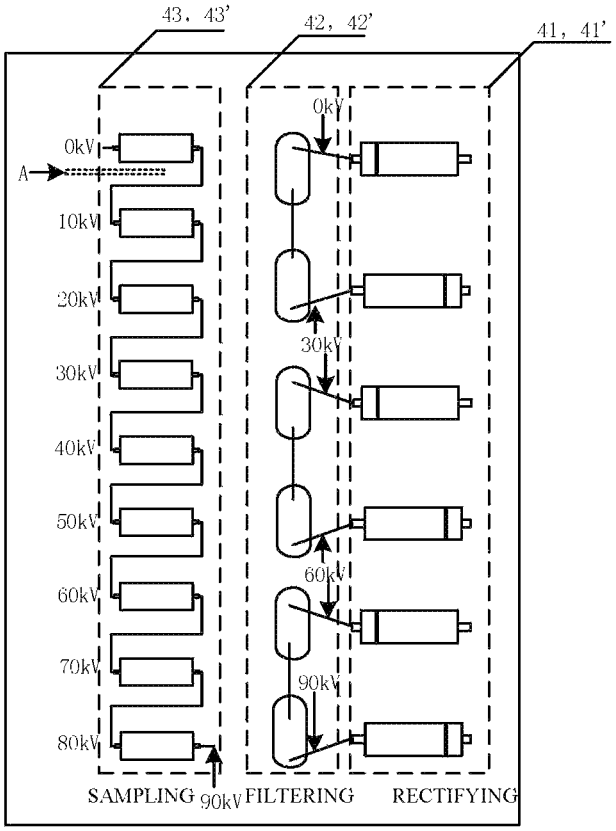
FIG. 5 is a schematic diagram illustrating specific structures of first and second circuit boards in a high voltage transformer apparatus according to an exemplary embodiment of the present disclosure.

As shown in FIG. 5, according to an exemplary embodiment of the present disclosure, a first circuit board and a second circuit board are respectively integrated with a rectifying unit (41, 41'), a filtering unit (42, 42'), and a sampling unit (43, 43'), configured to rectify, filter and sample the positive voltage generated by the first transformer unit and the negative voltage generated by the second transformer unit, respectively. By integrating the rectifying unit, the filtering unit and the sampling unit onto one circuit board, the wiring between the various circuit boards can be reduced compared to the solution of separating the rectifying circuit, the filtering circuit and the sampling circuit in the related art, which can simplify the assembly process.

According to an exemplary embodiment of the present disclosure, the first transformer unit includes a plurality of positive windings wound in series on the iron core 8, and the second transformer unit includes a plurality of negative windings wound in series on the iron core 8', to achieve higher voltages.

According to an exemplary embodiment of the present disclosure, at the same height level, the absolute values of the differences between the potentials of the rectifying unit, the filtering unit, and the sampling unit on the first circuit board and the potentials of the corresponding positive windings are no more than five kilovolts (kV), and the absolute values of the differences between the potentials of the rectifying unit, the filtering unit, and the sampling unit on the second circuit board and the potentials of the corresponding negative windings are no more than five kilovolts (kV).

Further, according to other embodiments of the present disclosure, at the same height level, the potentials of the rectifying unit, the filtering unit, and the sampling unit on the first circuit board and the potentials of the corresponding positive windings are the same; and the potentials of the rectifying unit, the filtering unit, and the sampling unit on the second circuit board and the potentials of the corresponding negative windings are the same. In this way, the distances between the transformer and the corresponding circuit boards for rectification, filtering and sampling may be minimized, thereby realizing a more compact design. The details will be described below with reference to FIG. 4 and FIG. 5.

Figure 4:
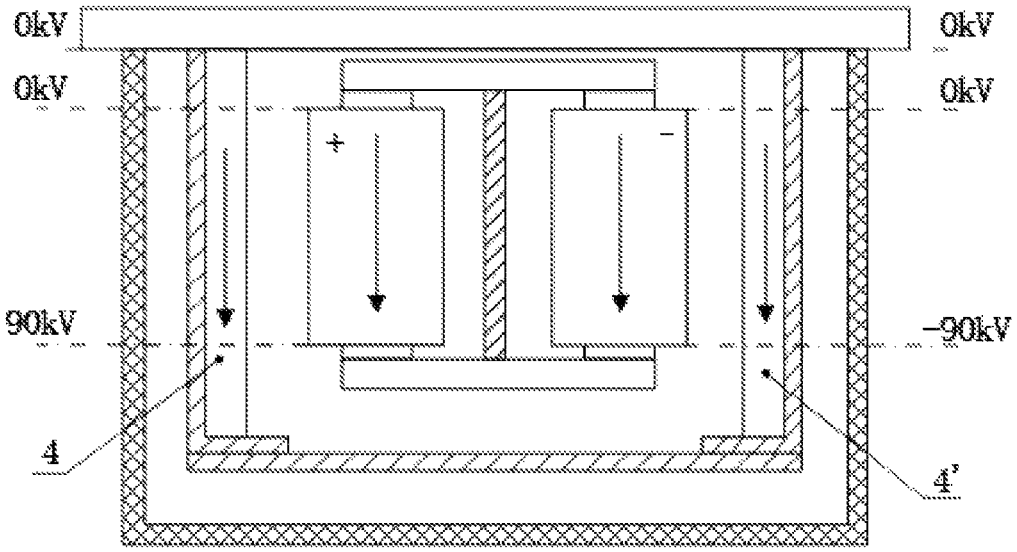
FIG. 4 is a schematic diagram of a high voltage transformer apparatus according to an exemplary embodiment of the present disclosure, which can achieve the same absolute value for a potential of a positive winding and a potential of a negative winding at the same height level.

As shown in FIG. 4, a positive voltage generated by the first transformer unit, increases from 0 to a certain value, such as 90 kV, in the direction indicated by an arrow. For an voltage on the adjacent first circuit board 4, it increases from 0 to 90 kV in the direction indicated by an arrow, from the upper end to the lower end. A negative voltage generated by the second transformer unit, decreases from 0 to a certain value, such as −90 kV, in the direction indicated by an arrow. Likewise, the voltage on the adjacent second circuit board 4' also decreases from 0 to −90 kV. In this way, the first and second transformer units and the adjacent circuit boards integrated with rectification, filtering, and sampling circuits have the same voltage at the same height level, so that the distances between the first and the second transformer units and the corresponding circuit boards 4 and 4' may be minimized, thereby realizing a more compact design. Based on electrical principles, for a potential difference of several tens of kilovolts between both ends, it is necessary to ensure a certain distance in space to avoid the discharge caused by such a high voltage. On the other hand, if the potentials at the two points in the space are equal, the distance required between the two ends can be quite small. The method of the present disclosure, as shown in FIG. 4, the voltage of the first transformer unit 2 increases from 0 to 90 kV from the top to the bottom, and the voltage of the first circuit board 4 adjacent to the first transformer unit 2 also increases from 0 to 90 kV from the top to the bottom. In addition, it can be ensured that at the same height level, the voltage of the first transformer unit 2 and the voltage of the first circuit board 4 are almost the same. In this way, the first circuit board 4 can be disposed very close to the transformer. Likewise, at the right side, the voltage of the second transformer unit 2' and the voltage of the second circuit board 4' decreases from 0 to −90 kV from the top to the bottom. Also, it can be ensured that at the same height level, the voltage of the second transformer unit 2' and the voltage of the second circuit board 4' are almost the same. In this way, the second circuit board 4' can be disposed very close to the transformer.

FIG. 5 shows a specific implementation structure of the circuit board 4 (4'). As shown in FIG. 5, the first (second) circuit board is integrated with a rectifying unit 41 (41'), a filtering unit 42 (42'), and a sampling unit 43 (43'), wherein the sampling unit is represented by nine resistors, the filtering unit is represented by six capacitors and the rectifying unit is represented by six diodes (the actual implementation is not limited to the manner illustrated in FIG. 5). Points connected with a line means they have the same potential. It can be seen that the points of the sampling unit having 90 kV potential are disposed adjacent to the points of the rectifying and filtering units having 90 kV potential; the points of the sampling unit having 60 kV potential is disposed adjacent to the portions of the rectifying and filtering units having 60 kV potential; and the points of the sampling unit having 30 kV potential is disposed correspondingly to the points of the rectifying and filtering units having 30 kV potential. Here, the first circuit board 4 is illustrated as an example, and the second circuit board 4' has the same configuration. In this way, it can be ensured that at the same height level, the adjacent points of the sampling, rectifying and filtering units have the same potential, and thus the distances between the sampling, rectifying and filtering devices on the circuit board can be reduced.

According to an example embodiment of the present disclosure, slots are provided between points having different potentials on the first circuit board and the second circuit board to further improve the insulation performance without increasing the size of the board. For example, a part of the circuit board between the 0 kV potential and the 10 kV potential is cut off, as shown by the portion A of FIG. 5. Other parts having potential differences may be handled in the similar manner, which will not be exhaustively listed here.

From the above detailed description, those skilled in the art will readily appreciate that the high voltage transformer apparatus according to the embodiments of the present disclosure can have one or more of the following advantages.

According to some embodiments of the present disclosure, the first transformer unit that generates a positive voltage and the second transformer unit that generates the negative voltage are disposed upright on the same side within the tank in the high voltage transformer apparatus, so that the high voltage transformer apparatus can be more easily fabricated, more compact and lighter in weight.

According to some embodiments of the present disclosure, by integrating the rectifying unit, the filtering unit and the sampling unit onto the same circuit board, the wiring between the various circuit boards can be reduced compared to the solution of separating the rectifying circuit, the filtering circuit and the sampling circuit, which can make assembly simple.

According to further embodiments of the present disclosure, the combination of solid insulating material and insulating oil makes it possible to reduce the distance between the high voltage components and the distance between the high voltage components and the wall of the high voltage tank as much as possible while satisfying the requirements of high voltage insulation, so that the size of the high voltage transformer apparatus can be further reduced.

According to other embodiments of the present disclosure, at the same height level, the potentials of the rectifying unit, the filtering unit, and the sampling unit on the first circuit board and the potentials of the corresponding positive windings are the same, and the potentials of the rectifying unit, the filtering unit, and the sampling unit on the second circuit board and the potentials of the corresponding negative windings are the same. In this way, the distances between the transformer and the corresponding circuit boards for rectification, filtering and sampling can be reduced as much as possible, thereby realizing a more compact design.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the disclosure only be limited by the appended claims.

What is claimed is:

1. A high voltage transformer apparatus, comprising:

a tank, comprising a first side wall, a second side wall, a top side and a bottom side, wherein the first side wall and the second side wall extend in the perpendicular to the the top side and the bottom side;

a high voltage transformer, disposed upright on one side within the tank, comprising a first transformer unit configured to generate a positive voltage and a second transformer unit configured to generate a negative voltage;

a positive high voltage terminal and a negative high voltage terminal, respectively disposed on the other side within the tank opposite to the first transformer unit and the second transformer unit;

a first circuit board, disposed between the first transformer unit, the positive high voltage terminal and the first side wall; and a second circuit board disposed between the second transformer unit and the second side wall, and the negative high voltage terminal;

wherein the first circuit board is configured to rectify, filter and sample the positive voltage generated by the first transformer unit, and the second circuit board is configured to rectify, filter and sample the negative voltage generated by the second transformer unit.

2. The high voltage transformer apparatus according to claim 1, wherein the first transformer unit comprises a plurality of positive windings, the second transformer unit comprises a plurality of negative windings, wherein the positive voltage generated by the plurality of positive windings of the first transformer unit gradually increases from zero potential along the vertical direction of the tank from top to bottom;

wherein the negative voltage generated by the plurality of negative windings of the second transformer unit gradually decreases from zero potential along the vertical direction of the tank from top to bottom; and for the positive winding and the negative winding positioned at the same horizontal line, absolute values of voltage potentials are the same.

3. The high voltage transformer apparatus according to claim 1, wherein the first circuit board is respectively integrated with a rectifying unit for rectifying the positive voltage generated by the first transformer unit, a filtering unit for filtering the positive voltage generated by the first transformer unit, and a sampling unit for sampling the positive voltage generated by the first transformer unit.

4. The high voltage transformer apparatus according to claim 3, wherein at the same height level, the rectifying unit, the filtering unit, and the sampling unit on the first circuit board have a first voltage potential, and the corresponding positive windings has a second voltage potential, wherein the absolute values of differences are no more than five kilovolts between the first voltage potential and the second voltage potential.

5. The high voltage transformer apparatus according to claim 3, wherein at the same height level, the rectifying unit, the filtering unit, and the sampling unit on the first circuit board have a first voltage potential, and the corresponding positive windings has a second voltage potential, wherein the first voltage potential is equal to the second voltage potential.

6. The high voltage transformer apparatus according to claim 1, wherein the second circuit board is integrated with a rectifying unit for rectifying the negative voltage generated by the second transformer unit, a filtering unit for filtering the negative voltage generated by the second transformer unit, and a sampling unit for sampling the negative voltage generated by the second transformer unit.

7. The high voltage transformer apparatus according to claim 6, wherein at the same height level, the rectifying unit, the filtering unit, and the sampling unit on the second circuit board have a first voltage potential, and the corresponding positive windings has a second voltage potential, wherein the absolute values of differences are no more than five kilovolts between the first voltage potential and the second voltage potential.

8. The high voltage transformer apparatus according to claim 6, wherein at the same height level, the rectifying unit, the filtering unit, and the sampling unit on the second circuit board have a first voltage potential, and the corresponding positive windings has a second voltage potential, wherein the first voltage potential is equal to the second voltage potential.

9. The high voltage transformer apparatus according to claim 1, wherein slots are disposed between points having different potentials on the first circuit board and the second circuit board.

10. The high voltage transformer apparatus according to claim 1, wherein the first transformer unit and the second transformer unit are electrically separated by an insulating plate.

11. The high voltage transformer apparatus according to claim 1, further comprising a first insulating layer, which is coated with the positive high voltage terminal and the negative high voltage terminal, respectively.

12. The high voltage transformer apparatus according to claim 1, further comprising a second insulating layer, which is disposed between the first circuit board and the first side wall, and disposed between the second circuit board and the second side wall, and disposed between components inside the tank and the bottom side of the tank.

13. The high voltage transformer apparatus according to claim 1, wherein the tank is filled with insulating oil.

14. The high voltage transformer apparatus according to claim 1, further comprising a tank cover, which is used to cover the top side of the tank.

* * * * *